US011548116B2

(12) United States Patent
McKenna

(10) Patent No.: US 11,548,116 B2
(45) Date of Patent: Jan. 10, 2023

(54) APPARATUS CONFIGURED TO PROVIDE BOTH WET AND DRY BLASTING AND METHOD FOR OPERATING SUCH AN APPARATUS

(71) Applicant: FLOWTECH INTERNATIONAL LTD, Newtownabbey (GB)

(72) Inventor: Jason McKenna, Holywood (GB)

(73) Assignee: FLOWTECH INTERNATIONAL LTD, Newtownabbey (GB)

( * ) Notice: Subject to any disclaimer, the term of this patent is extended or adjusted under 35 U.S.C. 154(b) by 939 days.

(21) Appl. No.: 16/335,063

(22) PCT Filed: Sep. 20, 2017

(86) PCT No.: PCT/EP2017/073840
§ 371 (c)(1),
(2) Date: Mar. 20, 2019

(87) PCT Pub. No.: WO2018/055012
PCT Pub. Date: Mar. 29, 2018

(65) Prior Publication Data

US 2019/0275640 A1 Sep. 12, 2019

(30) Foreign Application Priority Data

Sep. 20, 2016 (GB) ..... 1615958
Mar. 27, 2017 (GB) ..... 1704885

(51) Int. Cl.
*B24C 7/00* (2006.01)

(52) U.S. Cl.
CPC ..... *B24C 7/0069* (2013.01); *B24C 7/0046* (2013.01); *B24C 7/0076* (2013.01); *B24C 7/0084* (2013.01)

(58) Field of Classification Search
CPC ... B24C 7/0069; B24C 7/0046; B24C 7/0076; B24C 7/0084; B24C 7/0007; B24C 7/0023; B24C 7/0038; B24C 7/0061; B24C 7/003; B24C 3/06; B24C 5/02; B24C 5/04; B05B 7/1481
USPC ..... 451/37, 38, 39, 40, 90, 92
See application file for complete search history.

(56) References Cited

U.S. PATENT DOCUMENTS 4,209,952 A 7/1980 Odds
4,821,467 A * 4/1989 Woodson ..... B24C 7/0084 451/99
2016/0158915 A1 6/2016 Adan

FOREIGN PATENT DOCUMENTS

DE 2724318 9/1984
DE 19650171 11/1997
EP 0059173 9/1982
(Continued)

OTHER PUBLICATIONS

International Search Report dated Jan. 21, 2018.
(Continued)

*Primary Examiner* — Joel D Crandall
*Assistant Examiner* — Jacob Adam Montgomery
(74) *Attorney, Agent, or Firm* — Preston Smirman; Smirman IP Law, PLLC

(57) ABSTRACT

An apparatus for blasting having a distribution block for receiving a blasting medium, a pressure medium and/or a fluid/liquid medium, said distribution block having an outlet connectable with at least one distributing tube.

7 Claims, 8 Drawing Sheets

(56) References Cited

FOREIGN PATENT DOCUMENTS

Figure 1:
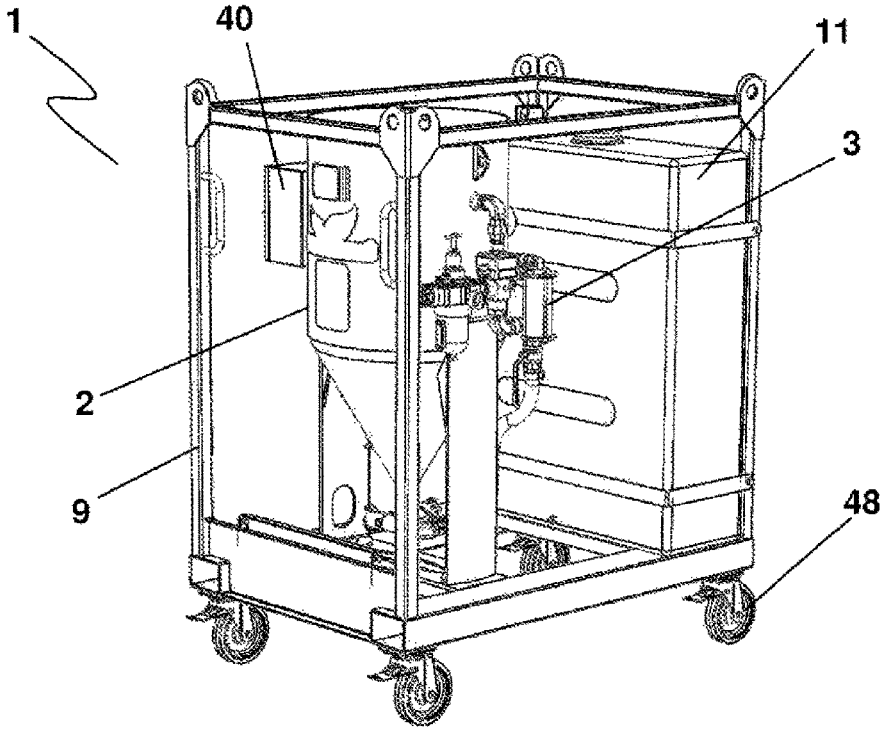

| | | |
|---|---|---|
| JP | 54122491 | 9/1997 |
| WO | 9522432 | 8/1995 |

OTHER PUBLICATIONS

Written Opinion of the International Searching Authority dated Jan. 21, 2018.
International Preliminary Report on Patentability dated Mar. 26, 2019.
Machine Translation of DE19650171, 1999.
Machine Translation of DE2724318, 1978.
English Abstract of JP54122491, 1978.

* cited by examiner

APPARATUS CONFIGURED TO PROVIDE BOTH WET AND DRY BLASTING AND METHOD FOR OPERATING SUCH AN APPARATUS

The present invention relates to an improved blasting apparatus and in particular to an improved apparatus for both wet and dry blasting.

For cleaning surfaces of for instance stone or metal, sand or a like blasting medium is typically used which, by means of a blasting apparatus, is sprayed under pressure against the surface to be cleaned. For this, at least the pressure to be used and the nature of the blasting medium should at any rate be adapted to the surface to be cleaned, because damage to the surface has to be prevented.

For blasting surfaces, known methods are used that are based on different principles. In particular, depending on the choice of the pressure medium, i.e. compressed air alone or water, it is possible to get hard or soft blasting, wherein hard is to be understood to mean highly corrosive while 'soft' is to be understood to mean relatively little corrosive. More in detail, when water is used, soft blasting takes place and while air and dry blasting medium are used, hard blasting takes place.

Moreover, blasting may take place in a "wet" and a "dry" manner. In the case of "wet" blasting, a blasting medium is at least substantially saturated or even supersaturated with water and this mixture is sprayed under pressure. In the case of "dry" blasting, the blasting medium is conducted to the spray nozzle in dry condition and sprayed there under pressure, the pressure being obtained through the feed of compressed air.

It is understood that, according to the kind of surface to be cleaned, the users selectively need to use wet or dry blasting. Anyway, known devices are configured to be used only for wet blasting or only for dry blasting, so the users must necessarily have two corresponding independent tools and change the tool according to their needs.

In such context, it is further known a blasting machine that can provide both wet and dry blasting. This machine has the drawback that the pressure vessel or hopper with wet blasting must be left to dry prior to any dry blasting being carried out and this is quite cumbersome since it can take even a couple of days.

Therefore, there is a need to have a single and integrated apparatus able to carry out at need both wet and dry blasting and able to save time for passing from wet to dry blasting mode without using additional add on wet blast injection nozzles or heads.

It is an object of the present invention to prevent or mitigate the problems of having and managing two separate tools for blasting or adding on retrofit equipment to modify or adapt a current dry blast pot for wet blasting, thus providing a single apparatus to be used at need both for wet blasting and dry blasting, Another object of the invention is to provide an apparatus that enables to pass easily, quickly, that is substantially instantaneously, and without hassle from wet to dry blasting mode, thus allowing for instance different types of surfaces to be cleaned in short sequence without damage.

Another object of the invention is to provide an apparatus that is highly versatile to cater for all blasting jobs and is safe for use in all its operating mode.

Another object of the invention is to provide an apparatus that reduces the risk of blockages typically present in the machine wherein the water is mixed with abrasive in the pressure vessel or hopper containing the blasting medium.

Another object of the invention is to provide an apparatus that enables both hard and soft blasting.

Another object of the invention is to provide an apparatus that is highly portable and is suitable for industrial use.

Another object of the invention is to provide an apparatus that requires little maintenance and can be of a relatively light construction and design, thus facilitating its movement and transportation.

Another object of the invention is to provide an apparatus that is environmentally friendly, readily controllable and user-friendly.

Another object of the invention is to provide a blasting apparatus that enables a simple and accurate control of blasting.

Another object of the invention is to provide a blasting apparatus that has an alternative and improved characterisation and design, in both constructional and functional terms, compared with the known ones.

Another object of the invention is to provide a blasting apparatus of easy, quick and low-cost construction.

Accordingly, all these objects, taken individually and in any combination thereof, are achieved according to the invention by an apparatus for blasting comprising a distribution block receiving selectively a blasting medium, a pressure medium and/or a fluid/liquid medium, said distribution block being provided of an outlet connected and/or connectable with at least one distributing means, said apparatus being configured and controlled so as to comprise:

- a first operating mode wherein via the outlet of the distribution block the blasting medium alone, that is with no fluid/liquid medium, is distributed by the pressure medium.
- a second operating mode wherein via the outlet of the distribution block the blasting medium with the fluid/liquid medium are distributed by the pressure medium.

Preferably, the apparatus is configured and controlled so as to it further comprises a third operating mode wherein via the outlet of the distribution block the pressure medium is distributed alone, that is with no blasting medium and with no fluid/liquid medium.

Ideally, the apparatus is configured and controlled so as to it further comprises a fourth operating mode wherein via the outlet of the distribution block the fluid/liquid medium alone, that is with no blasting medium, is distributed by the pressure medium.

Preferably, the third operating mode being performed in passing from the second operating mode to the first operating mode.

Ideally, said third operating mode being performed automatically in passing from the second operating mode to the first operating mode.

Preferably, the third operating mode is performed, most preferably automatically, after the second operating mode and before the start of the first operating mode.

Ideally, the third operating mode is automatically performed for a predefined time set by a timer.

Advantageously, in the third operating mode, the pressure medium is injected alone into the distribution block and/or in the distribution tube for removing moisture or residual that are present in the distribution block and/or in the distributing means.

Preferably, in the first operating mode and/or second operating mode the blasting means is distributed by means of the pressure medium.

Ideally, the blasting medium is an aggregate, most ideally sand and/or glass beads.

Preferably, the pressure medium is compressed air.

Ideally, the fluid/liquid medium is water.

Preferably, the distributing means comprises a hose and/or a nozzle.

Most preferably, the distributing means comprises a hose terminating with a spray nozzle.

Ideally, the first operating mode corresponds to a dry blasting.

Preferably, the second operating mode corresponds to a wet blasting.

Ideally, the third operating mode corresponds to a dry cleaning.

Preferably, the fourth operating mode corresponds to a wet cleaning or washing under pressure.

Ideally, the distribution block is configured so that in order to change operating mode from the second operating mode to the first operating mode the pressure medium is distributed alone into the distribution block for removing any moisture in the distribution block and in its downstream portion, that is the distributing means connected/connectable to the outlet of the distribution block.

Preferably, the apparatus comprises a storage means for the blasting medium.

Ideally, the apparatus comprises a compressor and/or a connection means to connect the apparatus to an external compressor for providing a pressure medium within the distribution block.

Preferably, the storage means for the blasting medium and/or the compressor are integrated with or coupled to a housing framework.

Ideally, the storage means and the compressor are built-in to the housing framework Preferably, the housing framework is provided with moving means.

Ideally, the storage means for the blasting medium is connected with the distribution block by a control valve.

Preferably, this control valve connecting the storage means for the blasting medium with the distribution block is normally closed.

Ideally, the control valve is positioned proximal to the base of the storage means for the blasting medium so that, when the control valve is at least in part opened, the blasting medium can fall by gravity into the distribution block.

Preferably, the control valve is positioned upon the base of the storage means for the blasting medium so that, when the control valve is at least in part opened, the blasting medium can fall by gravity into the distribution block.

Ideally, the control valve is configured to selectively admit/interrupt, and preferably also meter, the flow of the blasting medium into the distribution block.

Preferably, the distribution block comprises a chamber placed downstream of the control valve and communicating with it.

Ideally, a portion of the storage means for blasting medium is open so that the blasting medium can enter into it both prior to and/or during the use of the apparatus Preferably, the upper side of the storage means for blasting medium is open so that the blasting medium can enter into it both prior to and/or during the use of the apparatus.

Ideally, the compressor is configured to provide a pressurized medium, most ideally compressed air, within the distribution block.

Preferably, the compressor is connected with the distribution block by a pressure line.

Ideally, the pressure line is provided with at least one control valve for selectively admitting/interrupting and/or metering the entry of the pressure medium into the distribution block.

Preferably, the pressure line is provided with at least one control valve for regulating the pressure of the pressure medium entering into the distribution block.

Ideally, the pressure line is further connected with the interior of the storage means for blasting medium in order to provide an agitating and mixing effect on the blasting medium contained in the storage means for blasting medium.

Preferably, vibrating means are associated to the storage means for blasting medium for providing agitating and mixing effect on the blasting medium contained in the storage means for blasting medium.

Ideally, the distribution block comprises a first inlet for the entry of the pressure medium, a second inlet for the entry of the blasting medium and the outlet connected and/or connectable with at least one distributing means.

Preferably, the first and second inlets are defined in said chamber located downstream of the control valve.

Ideally, the first inlet is connected to the compressor via the pressure line.

Preferably, the second inlet for the blasting medium is connected with the storage means for blasting medium via the control valve for the blasting medium.

Ideally, the apparatus is configured so that, in the first operating mode, the blasting to medium is mixed with the pressure medium within, and preferably only within, the distribution block.

Preferably, the apparatus comprises a circuit for supplying a fluid/liquid medium into the distribution block.

Ideally, the fluid/liquid medium supplying circuit comprises a supply line by means of which the fluid/liquid medium is injected into the distribution block.

Preferably, the supply line is provided with at least one control valve for selectively admitting/interrupting and/or metering the entry of the fluid/liquid medium into the distribution block.

Preferably, the supply line is provided with at least one control valve for regulating the pressure and/or the flow of the fluid/liquid medium entering into the distribution block.

Ideally, the supply line is provided with a pump for injecting the fluid/liquid medium into the distribution block.

Preferably, the supply line is connected with a fluid/liquid medium storage means containing the fluid/liquid medium and/or is connectable with an external supplying line.

Ideally, the fluid/liquid medium storage means is fitted and built into the housing framework of the apparatus.

Preferably, the distribution block further comprises a third inlet for the fluid/liquid medium.

Ideally, the third inlet is connected to the fluid/liquid medium supplying circuit.

Preferably, the apparatus is configured so that, in the second operating mode, the blasting medium is mixed with the pressure medium and with the fluid/liquid medium within, and preferably only within, the distribution block.

Advantageously, in the second operating mode, the fluid/liquid medium is combined with the pressure medium and the blasting medium in the distribution block so as to ensure that the slurry, that is formed by the mixing of the fluid/liquid medium with the pressure medium and the blasting medium, is created prior to exiting the distributing means.

Ideally, in the distribution block the first, second and third inlets are separated.

Preferably, the third inlet for the entry of the fluid/liquid medium is placed downstream of the first and second inlets.

Ideally, in the distribution block the second inlet for the entry of the blasting medium is closer to the first inlet for the entry of the pressure medium than to the third inlet for the entry of the fluid/liquid medium.

Preferably, the circuit for supplying the fluid/liquid medium is configured to inject into the distribution block the fluid/liquid medium at a pressure substantially equal to or greater than 100 psi.

Advantageously, having the circuit for supplying the fluid/liquid medium configured to inject into the distribution block the fluid/liquid medium at a pressure substantially equal to or greater than 100 psi overcomes back pressure which is present in the valve to successfully inject the fluid/liquid medium.

Ideally, the distribution block comprises a coupling means provided with the third inlet for the injection of the fluid/liquid medium within the distribution block.

Preferably, the coupling means is located downstream of the chamber and communicates with the chamber.

Ideally, the distribution block comprises the chamber and the coupling means.

Preferably, the chamber is integrated in the control valve of the blasting medium and is defined in the portion located downstream of the shutter of this control valve.

Ideally, the coupling means is fitted downstream of the control valve of the blasting medium.

Preferably, the coupling element is designed to fit a standard control valve for blasting medium, thus enabling the conversion of a standard dry blast machine or device into a wet blast machine.

Ideally, the coupling means comprises a substantially tubular body that is provided on its lateral wall with the third inlet defining a fluid/liquid well ingress into the distribution block.

Preferably, the fluid/liquid well ingress comprises an aperture passing through the lateral wall of the body of the coupling means.

Ideally, the fluid/liquid well ingress comprises a circumferential trough defined around the external lateral wall of the inner body.

Preferably, the coupling means comprises at one end means for its securing to the control valve of blasting medium.

Ideally, the coupling means comprises at an opposing end, relative to the end comprising means for its securing to the control valve, means for its fastening with a distributing means.

Preferably, the coupling means comprises two pieces that are welded together to form one piece.

Ideally, the coupling means comprises an outer sleeve that is welded centrally over the fluid/liquid well ingress defined in the inner body in order to form a single piece.

Preferably, the coupling means comprises a plurality of internal jets having a small diameter and communicating with the fluid/liquid well ingress, by which the fluid/liquid medium is injected into the distribution block according to the same direction of the flow of pressure medium.

Ideally, the apparatus comprises a system for monitoring the fluid/liquid level in the fluid/liquid medium storage means.

Preferably, the fluid/liquid level monitoring system is connected with the compressor and/or with a valve of the pressure line and/or with the control valve of the blasting medium in order to stop automatically the second operating mode of the apparatus when the liquid/fluid level in the fluid/liquid medium storage means drops below a predefined minimum level.

Ideally, the fluid/liquid level monitoring system comprises a switch that is activated by a float assembly, that is provided in the fluid/liquid medium storage means, when the fluid/liquid level in the fluid/liquid medium storage means falls below a predefined minimum level.

Preferably, the fluid/liquid level monitoring system comprises an actuating element, located proximal to the base of the fluid/liquid medium storage means, that is configured to act on a normally-closed valve when the fluid/liquid reaches a minimum level, said actuating element being controlled by a float travelling along guiding means as the fluid/liquid level changes Preferably, the fluid/liquid level monitoring system comprises an actuating element, located in the base of the fluid/liquid medium storage means, that is configured to act on a normally-closed valve when the fluid/liquid reaches a minimum level, said actuating element being controlled by a float travelling along guiding means as the fluid/liquid level changes.

Ideally, the fluid/liquid level monitoring system is configured so that, when the fluid/liquid level in the fluid/liquid medium storage means is too low, the float pulls on the actuating element that, due to the weight of the float, counteracts and compresses a spring which closes the valve, which in turn, interrupts the feed of pressure medium and/or blasting medium in the distributing block.

Alternatively, the fluid/liquid level monitoring system comprises an actuating element, located proximal to the apex of the fluid/liquid medium storage means, that is configured to act on a normally-closed valve when the fluid/liquid reaches a minimum level, said actuating element being controlled by a float travelling along guiding means as the fluid/liquid level changes.

In the alternative, the fluid/liquid level monitoring system comprises an actuating element, located at the apex of the fluid/liquid medium storage means, that is configured to act on a normally-closed valve when the fluid/liquid reaches a minimum level, said actuating element being controlled by a float travelling along guiding means as the fluid/liquid level changes.

In the alternative, the fluid/liquid level monitoring system is configured so that, when the fluid/liquid level in the fluid/liquid medium storage means is too low, the float pulls on the actuating element that, due to the weight of the float, extends a spring which closes the valve, which in turn, interrupts the feed of pressure medium and/or blasting medium in the distributing block.

Preferably, the apparatus comprises an electronic control system for controlling one or more of the following components: the control valve of the blasting medium, the compressor, the valves in the pressure line, the pump and/or the valves in the fluid/liquid supply circuit.

Ideally, the apparatus further comprises a control panel provided with input means for selecting the operating mode of the apparatus itself.

Preferably, the apparatus comprises an emergency stop for commanding the interruption of the operating of the apparatus.

Ideally, the apparatus is configured that, in its third operating mode, the entrances in the distribution block of blasting medium via the second inlet and of fluid/liquid medium via the third inlet are interrupted so that the pressure medium entering via the first inlet passes alone into the outlet of the distribution block that is connected and/or connectable with at least one distributing means.

Preferably, the apparatus is configured that, in its fourth operating mode, the entrance in the distribution block of blasting medium via the second inlet is interrupted by closing the control valve of the blasting medium so that the fluid/liquid medium entering via the third inlet, together with the pressure medium entering via the first inlet, pass into the outlet of the distribution block that is connected and/or connectable with at least one distributing tube.

Ideally, the apparatus comprises a timer associated with the fluid/liquid supply circuit to control the timing of the fluid/liquid injection into the distribution block.

Preferably, the fluid/liquid medium storage means is a storage tank.

Ideally, the blasting medium storage means is a storage vessel.

Accordingly, the present invention provides an improved method for operating an apparatus configured to provide both wet and dry blasting characterized in that, in passing from wet to dry blasting, a cleaning step is performed before starting the dry blasting, during said cleaning step the pressure medium is sent alone, with no blasting medium and with no fluid/liquid medium, within and along the distributing means of the apparatus.

The skilled man will appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which show by way of example only one embodiment of a screen box in accordance with the invention.

Figure 2:
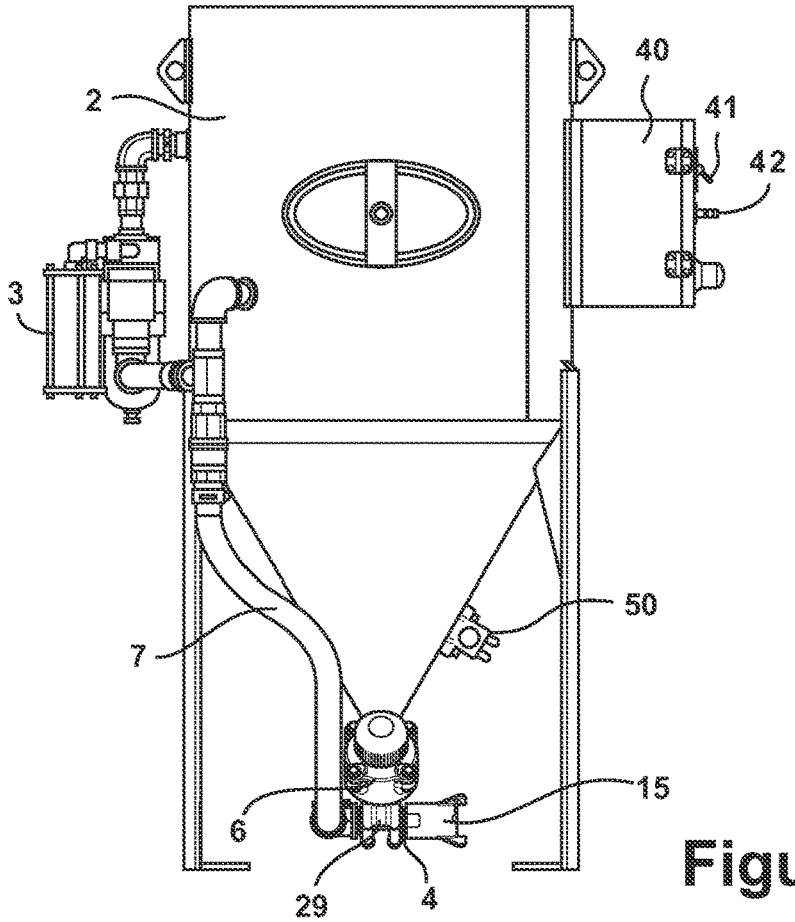
Figure 3:
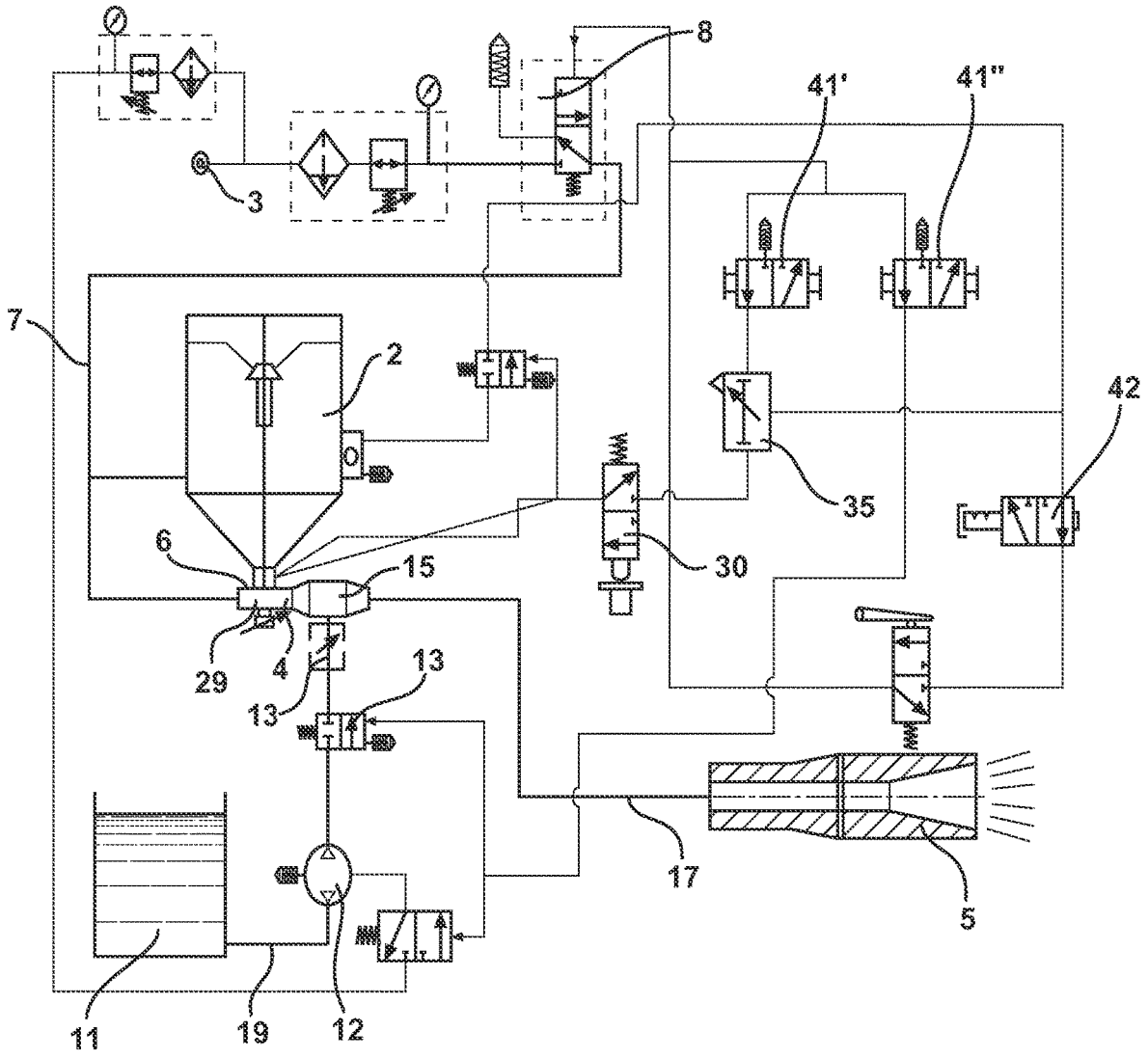
Figure 4:
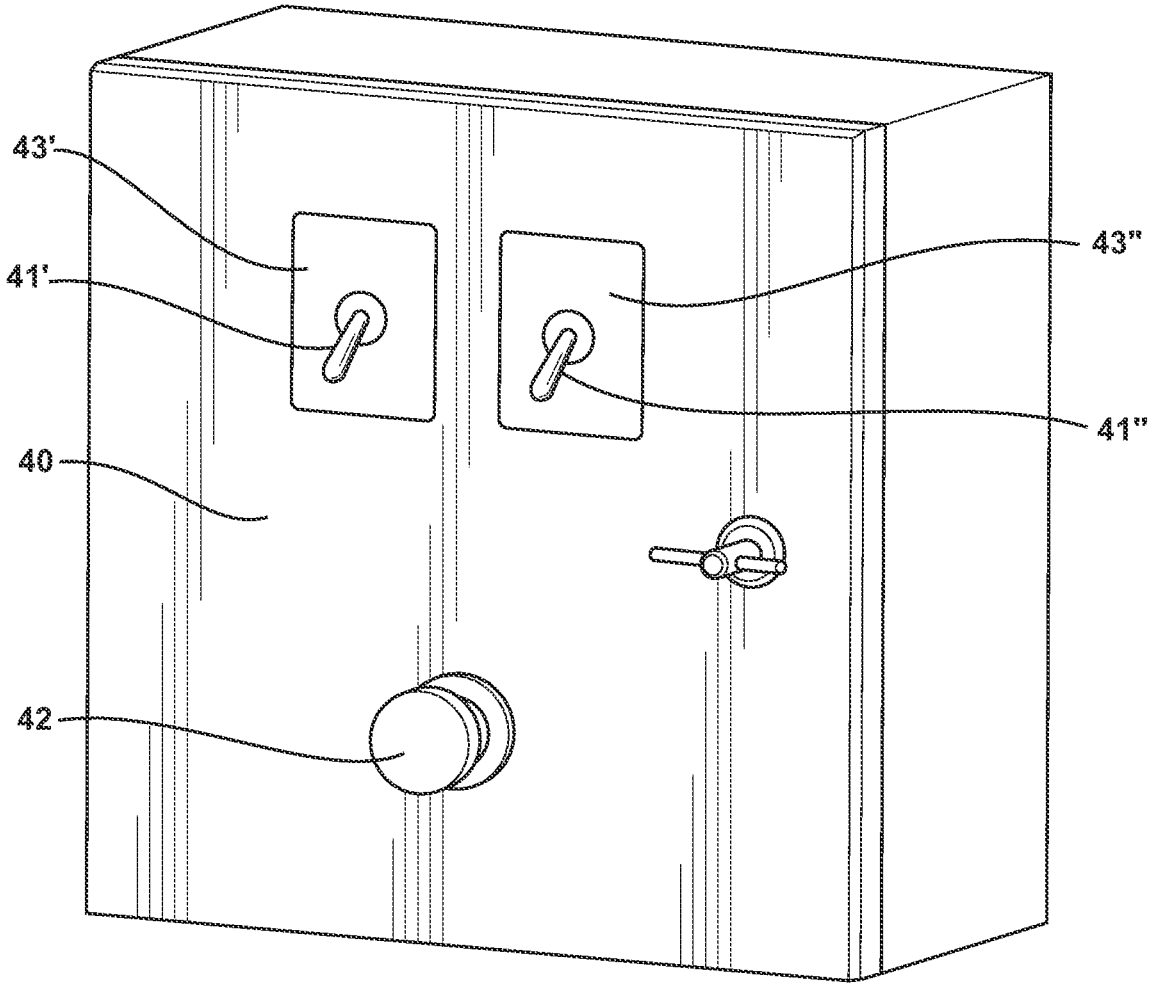
Figure 5:
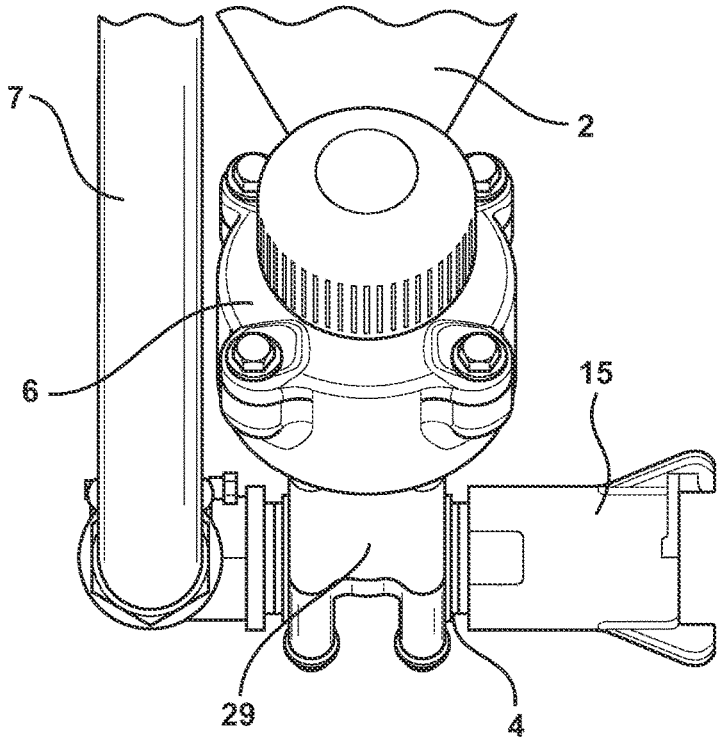
Figure 6:
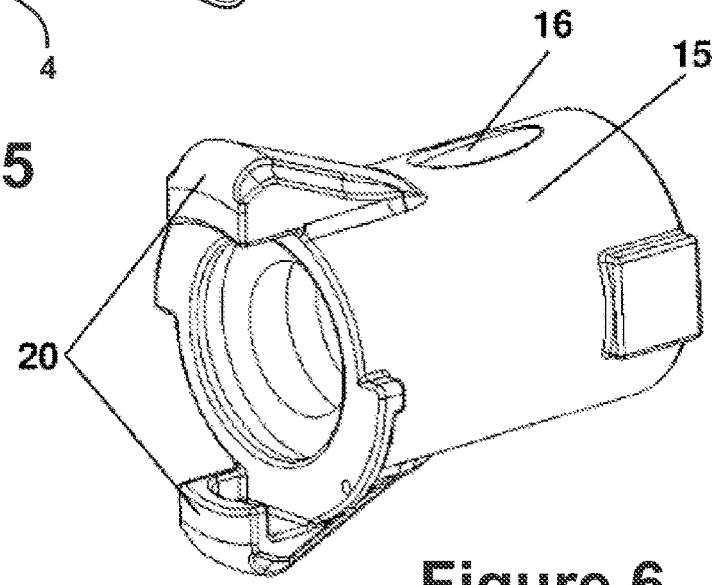
Figure 7:
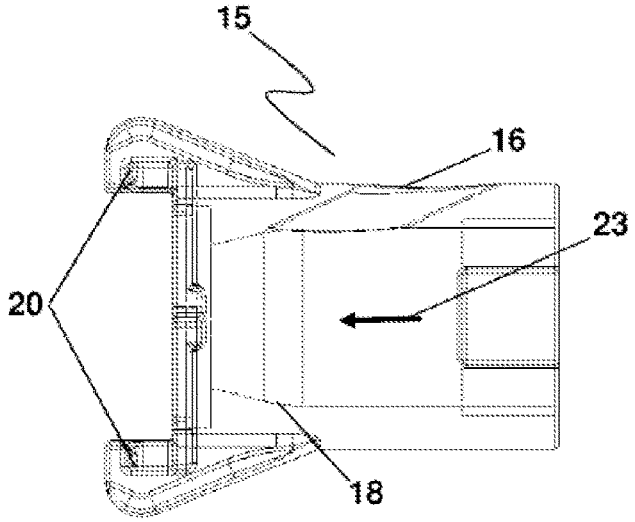
Figure 8:
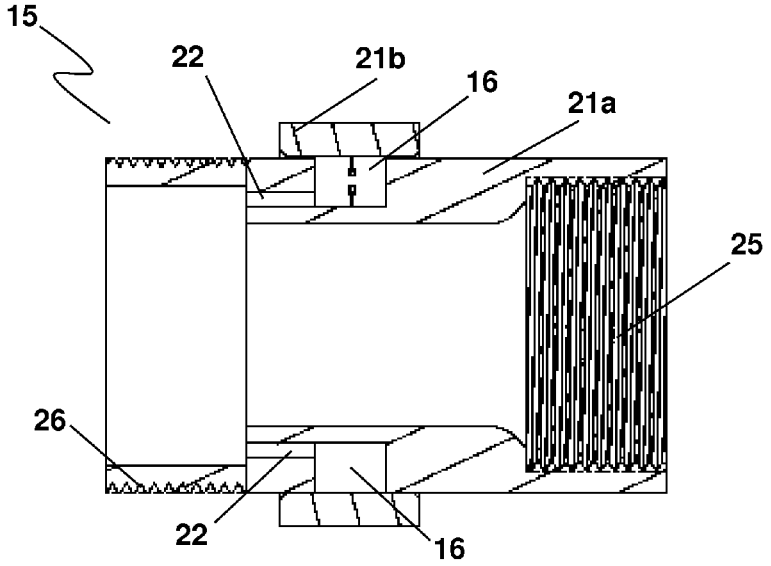
Figure 9:
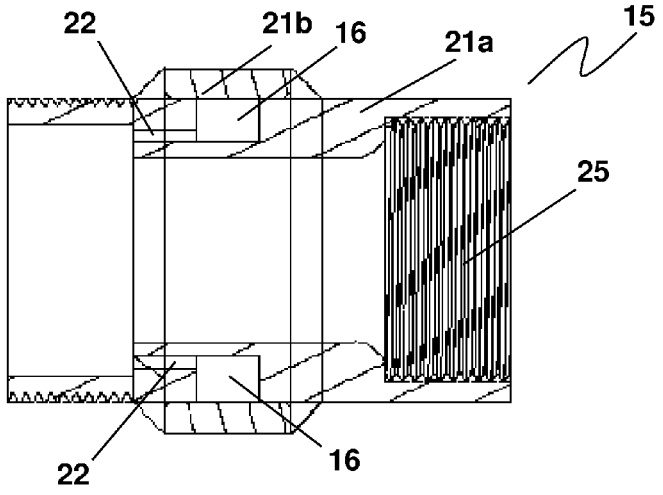
Figure 10:
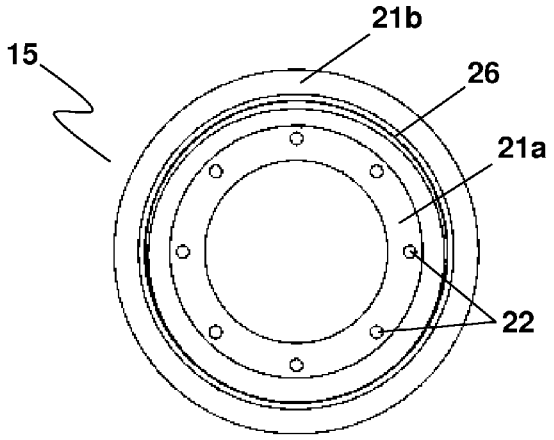
Figure 11:
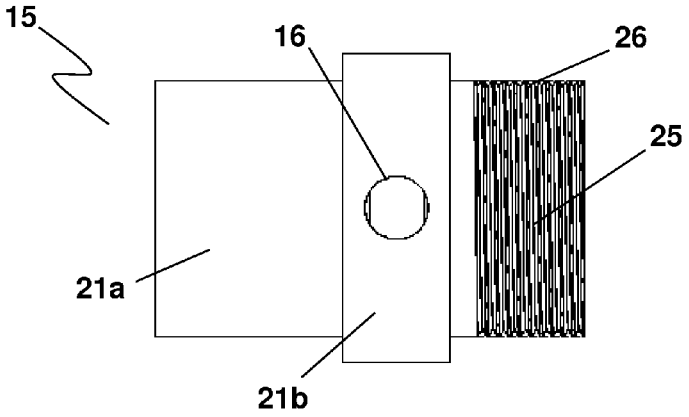
Figure 12:
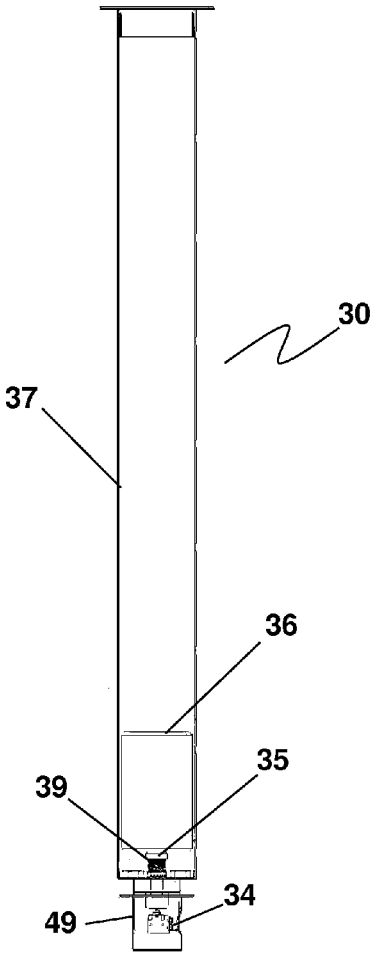
Figure 13A:
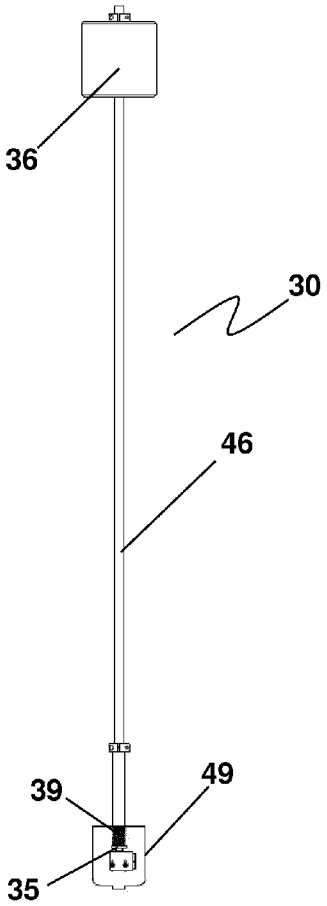
Figure 13B:
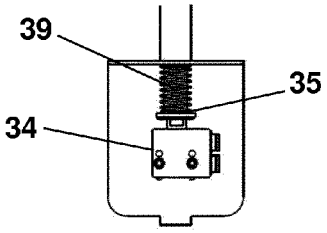
Figure 14:
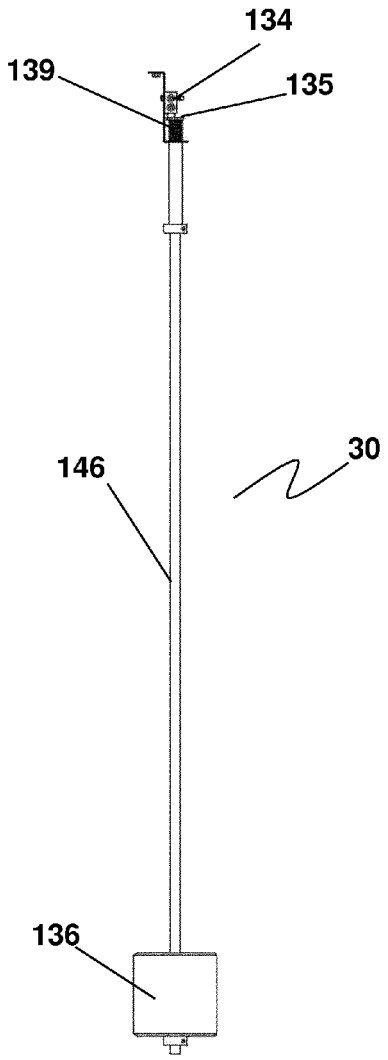

In the drawings:

FIG. 1 is a perspective view of a blasting apparatus according to the invention, FIG. 2 is a rear view of the apparatus of FIG. 1, FIG. 3 is a schematic circuit of the apparatus according to the invention, FIG. 4 is an exploded view of the control panel of the apparatus according to the invention, FIG. 5 is an enlarged view of the particular of FIG. 2, FIG. 6 is a view of a first embodiment of a coupling element for water injection, FIG. 7 is a cross section view of the coupling element of FIG. 6, FIG. 8 is a first cross section of a different embodiment of the coupling element for water injection, FIG. 9 is a second cross section of the coupling element of FIG. 8, FIG. 10 is a front view of the coupling element of FIG. 8, FIG. 11 is a lateral view of the coupling element of FIG. 8, FIG. 12 is a general view of a first embodiment of the level monitoring system, FIG. 13*a* is a view of a different embodiment of the level monitoring system, and FIG. 13*b* is an enlarged view of a particular of FIG. 13*a*, FIG. 14 is a view of a further embodiment of the level monitoring system.

Referring to the FIGS. 1 and 2, there is shown the general view of a blasting apparatus 1 according to the invention and it comprises a storage vessel 2 for the blasting medium, a compressor 3, a distribution block 4 that is connected with a spray nozzle 5 via a blasting hose 17.

Advantageously, the apparatus 1 comprises a housing framework 9 into which the various components are placed and supported. Preferably, the housing framework 9 further comprises wheels 48 or other suitably means for facilitating the moving of the whole apparatus.

In particular, the storage vessel 2 comprises a tank with a lower funnel-shaped hopper portion and is provided, at its lower side, with a control valve 6, that is normally closed, for selectively admitting/interrupting, and preferably also metering, the blasting medium into the distribution block 4.

Advantageously, the control valve 6 for the blasting medium is positioned at the bottom of the storage vessel 2 so that, when the control valve 6 is at least in part opened, the blasting medium can fall by gravity into the distribution block 4.

Preferably, the upper side of the storage vessel 2 is open or is provided with an easy openable door so that the blasting medium can be thrown into it and this may take place prior to as well as during the use of the apparatus, because the storage vessel 2 is always in or can always be brought into open communication with the surroundings.

As blasting medium, preferably silicon-free or silicon-poor sand is used, but other blasting media such as glass beads can be used as well. At need, chemicals, for instance, can also be fed together with the blasting medium.

The compressor 3 is configured to provide a pressurized medium, preferably compressed air, within the distribution block 4. At its pressure side, the compressor 3 comprises a pressure line 7 which connects the compressor 3 itself with the distribution block 4. Preferably, in the pressure line 7 an air control valve 8 is accommodated for admitting/interrupting, and preferably also for metering, the flow and/or pressure of air entering the distribution block 4.

Advantageously, the pressure line 7 may be further connected with the interior of the storage vessel 2 in order to provide an agitating and mixing effect on the blasting medium. Alternatively or additionally, for the same aim, vibrating means 50 can be associated to the storage vessel 2.

The distribution block 4 jointly connect the pressure line 7 and the feed of the blasting medium coming from the storage vessel 2 to a blasting hose 17 terminating in the spray nozzle 5.

By switching on the apparatus in a first operating mode (that corresponds to the dry blasting), the control valve 6 is at least in part open so that the blasting medium in the storage vessel 2 passes in the distribution block 4. At the same time, compressed air is fed to the distribution block 4 by means of the compressor 3. In the distribution block 4, the flow of blasting medium and the flow of compressed air are mixed and conducted through the blasting hose 17 to the spray nozzle 5, where the blasting medium is sprayed under high pressure. Advantageously, by commanding the control valve 8 of the pressure line 7 the magnitude of the flow of compressed air is set and this enables the composition of the blast sprayed to be set in a particularly simple and accurate manner.

The apparatus 1 according to the invention further comprises a circuit 19 for supplying fluid/liquid, preferably water. In particular said water circuit 19 comprises a water supply line 10 by means of which water is injected into the distribution block 4.

The supply line 10 can be connected with a water tank 11 and/or can be connected to an external water supplying line. In particular, in a first version of the apparatus, preferably intended to be used as a static version, the water tank 11 may be fitted and built into the housing framework 9 of the apparatus and, in this case, in the apparatus 1 are further integrated means for adjusting the pressure and/or flow of water. In another version of the apparatus, preferably intended to be used as a portable version, there is a connection with an external water line.

In particular, connected to the water tank 11 there is a water pump 12 and at least one regulating valve 13 for admitting/interrupting, and preferably also for metering, the flow and/or the pressure of water entering into the distribution block 4.

More in detail, the distribution block 4 comprises a chamber 29 that is placed downstream the control valve 6 for blasting medium. In particular, this chamber 29 is integrated in the control valve 6 and is defined in the zone placed downstream of the shutter of the valve itself. Moreover, the chamber 29 comprises a first inlet connected with the pressure line 7 for the entry of the pressure medium and a second inlet for the entry of the blasting medium. In particular, said second inlet is defined in the portion of the control valve 6 that is provided with the shutter and communicates with the storing vessel 2.

Advantageously, the distribution block 4 further comprises a coupling element 15 for connecting the water supply circuit 19 with the pressure line 7 and the feed of the blasting medium coming from the storage vessel 2. In particular, said chamber 29 is further provided with an outlet communicating with the interior of the coupling element 15 that is suitably provided on its lateral wall with a third inlet communicating with the water supplying circuit 19 for the water injection within the coupling element itself.

By switching on the apparatus in a second operating mode (that corresponds to the wet blasting), the control valve 6 is at least in part open so that the blasting medium in the storage vessel 1 passes in the distribution block 4 where is mixed with the water of the supply circuit 19 that enters into the distribution block 4 via the coupling element 15. Therefore, within the distribution block 4 the water is mixed with the blasting medium and put under high pressure by means of the flow of compressed air that is fed via the pressure line 11, thus obtaining a slurry mixture that is subsequently forced through the blasting hose 17 until the spray nozzle 5, where it is sprayed under high pressure.

In the distribution block 4, the coupling element 15 is fitted downstream of the control valve 6 of the blasting medium in order to prevent the water ingress in correspondence of the flow exit point of the blasting medium from the storing vessel 2. Advantageously, the water supply circuit 19 is configured so that into the coupling element 15 is injected water at pressure substantially equals or greater than 100 psi in order to overcome back pressure within the blasting hose.

Advantageously, the coupling element 15 is designed to fit a standard control valve for blasting medium, thus enabling the conversion of a standard dry blast apparatus, machine or device into a wet blast machine.

Advantageously, the coupling element 15 is designed and configured to enable the injection of water within the distribution block 4 close to the control valve 6 for the blasting medium, thus replacing the need for a water injection blasting nozzle. Furthermore, the coupling element 15 is designed so as to keep the water injection out of the flow of air and blasting medium and this allows to reduce or eliminate internal coupling wear.

Advantageously, the coupling element 15 comprises a substantially tubular body that is provided on its lateral wall with a water well ingress 16 into the distribution block 4.

In particular, in the embodiment of the coupling element 15 shown in FIGS. 6 and 7, it comprises a Venturi section 18 that is defined at the end opposite to the end of air entry. The water well ingress 16 is defined by an aperture passing through the lateral wall of the body. Moreover, the coupling element 15 comprises claws 20 for fastening the terminal of the blasting hose 17.

In the embodiment of the coupling element 15 shown in figures from 8 to 11, it comprises two pieces 21*a* and 21*b*, preferably made of stainless steel in order to prevent corrosion, that are welded together, preferably by means of a TIG inert gas process, to form one piece. The water well ingress 16 is defined by a circumferential trough defined around the external lateral wall of the inner body 21*a*. The outer sleeve 21*b* is welded centrally over the water well ingress 16 defined in the inner body 21*a* in order to form a single piece.

Moreover, the coupling element 15 features a plurality of internal jets 22, having a small diameter (for example of about 2 mm) and communicating with the water well ingress 16, by which the water is injected into the interior of the coupling element 15 according to the same direction 23 of the flow of compressed air and blasting medium in order to form a slurry within a distribution block 4.

The coupling element 15 features a female thread 25 at one side for its connection with the control valve 6 of the blasting medium and at the opposite side it features a male thread 26 for coupling, directly or by means of a further reducer, with the blasting hose 17.

Advantageously, the water tank 11 of the apparatus is provided with a water level monitoring system 30.

Preferably, the water level monitoring system 30 is connected with the compressor 3 and/or with a suitable valve of the pressure line 7 and/or with the control valve 6 of the blasting medium in order to control them for safety so that, if the water level in the tank 11 drops below a certain level, that is the flow level required for working, the system 30 will deactivate automatically the second operating mode (i.e. the wet blasting). This allows to minimize the possibility of unexpected loss of supply during wet blasting, thus avoiding the possibility to cause damage to the components being blasted.

In particular, the water level monitoring system 30 comprises a switch, preferably implemented by a valve, that is activated by a float assembly provided in the water tank 11 when the water level in said tank falls below a predefined minimum level.

More in detail, as shown in FIGS. 12, 13*a* and 13*b*, the water level monitoring system 30 comprises a plunger 35, placed in the base of the water tank 11, that is loaded by a spring 39 and which actuates a normally-closed valve 34 when the water reaches a minimum level. The plunger 35 is actuated by a float 36 which travels up and down within a guiding tube 37, or along a guiding stem 46, as the water level changes.

The water level monitoring system 30 is operated via the float 36 that acts on the plunger 35 that is spring loaded on the normally closed valve 34, that is preferably a pneumatic 2/2-way valve and is housed in a protective cover 49. When the water level in the tank 11 is too low, the float 36 pulls on the plunger 35 that, due to the weight of the float, counteracts and compresses a spring 39 which closes the valve 34, which in turn, breaks the air supply in the pressure line 11 by acting on a corresponding valve (for example the valve 8) and/or interrupts the feed of blasting medium in the distribution block 4 by closing the control valve 6, thus deactivating the blasting. In this case, the user must refill water in the water tank 11 or select the first operating mode (i.e. dry blasting) to continue.

Alternatively, as shown in FIG. 14, the water level monitoring system 30 comprises a plunger 135, placed proximal to top of the water tank 11, that is loaded by a spring 139 which actuates a normally-closed valve 134 when the water reaches a minimum level. The plunger 135 is actuated by a float 136 which travels up and down within a guiding tube or along a guiding stem 146, as the water level changes. In this embodiment, the water level monitoring system 30 is operated via the float 136 that acts on the plunger 135 that is spring loaded on the normally closed valve 134. When the water level in the tank 11 is too low, the float 136 pulls on the plunger 135 and extends the compressed spring 139 which closes the valve 134, which in turn, breaks the air supply in the pressure line 11 by acting on a corresponding valve and/or interrupts the feed of blasting medium in the distribution block 4 by closing the control valve 6, thus deactivating the blasting.

The apparatus 1 may comprise an electronic control system (processor) by means of which the control valve 6 of the blasting medium, the water and air stop valves respectively in the water circuit 19 and in the pressure line 7, the water control valve 13, the air control valve 8, air and water pressure reducing valve, the speed of the compressor 3 and/or of the pump 12 can be controlled, so that during operation the optimum setting can always be selected without the work having to be interrupted therefor. For checking purposes, manometers may be provided at various locations in the water circuit 19 and the pressure line 7.

Advantageously, the apparatus 1 further comprises a control panel 40 provided with input means, preferably with two toggle switches 41' and 41", for selecting the various operating mode of the apparatus itself. Preferably, each switch 41' and 41" is provided with a respective label 43' and 43" for indicating to the user the meaning of the corresponding switch position.

Advantageously, the control panel 40 further comprises an emergency stop 42 for the interrupting instantaneously the operating of the apparatus.

The apparatus 1 according to the invention is configured to work according to the above mentioned main operating modes:

- the first operating mode, corresponding to the dry blasting, that is set up by selecting the option "dry" together with the option "blast" via the two respective toggle switches 41 located on the control panel 40, and
- the second operating mode, corresponding to the wet blasting with abrasive slurry, that is set up by selecting the option "wet" together with the option "blast" via the two respective toggle switches 41 located on the control panel.

Advantageously, the apparatus 1 according to the invention is configured to work according a third operating mode wherein the pressure medium alone (i.e. compressed air with no water and with no blasting medium), that is provided by the compressor 3 via the pressure line 7, is purged in the distribution block 4 while the control valve 6 of the blasting medium is closed and the injection of water from the water supply circuit 19 is interrupted. In particular, the third operating mode corresponds to the dry blow down for cleaning and may be manually set up by the user by selecting the option "dry" together with the option "clean" via the two respective toggle switches located on the control panel.

Advantageously, the apparatus according to the invention is further configured to work according a fourth operating mode, wherein the water of the supply circuit 19 that enters into the distribution block 4 via the coupling element 15 is put under high pressure by means of the flow of compressed air that is fed via the pressure line 11, while the control valve 6 remains closed so that the blasting medium does not enter in the distribution block 4. In particular, the fourth operating mode corresponds to the wet wash down for cleaning and may be manually set up by selecting the option "wet" together with the option "clean" via the two respective toggle switches located on the control panel, Therefore, by acting on the control panel 40 of the apparatus 1, the user command the apparatus to work according to one of the above described operating mode.

Advantageously, when the second operating mode is selected by acting on the control panel 40, the associated electronic control system commands the activation of the water pump 12 to inject water into the distribution block 3 via the coupling element 15. In this way, water is injected into the distribution chamber, 4 wherein the blasting stream has been already formed by the mixture of compressed air coming from the pressure line 7 with the blasting medium coming from the storing vessel 2 via the control valve 6, so as to create an abrasive slurry mixture comprising compressed air, the abrasive medium and water.

As said before, in the second operating mode, the water is combined with compressed air and the blasting medium at the distribution block 4 and prior to exiting the blasting nozzle 5 so as to ensure that the slurry is created prior to exiting said nozzle.

Advantageously, the apparatus 1 comprises a timer 45 associated with the water to supply circuit 19 to control the timing of the water injection into the distribution block 4 during the third operating mode. More in detail, this timer 45 may be associated with the water regulating valve 13 of the water supplying circuit 19 in order to suitably allow or interrupt the water passage toward the distribution block 4. Advantageously, the setting of the timer is suitably adjustable by acting on the control panel 40 of the apparatus.

Advantageously, the electronic control system is configured so that, when it is selected a passage from the second operating mode (wet blasting) to the first operating mode (dry blasting) by acting on the corresponding switch of the control panel 40, the third operating mode is performed automatically for an adjustable time period, for example up to 15 seconds, defined by said timer. More in detail, in this third operating mode the air alone (i.e. with no water and with no blasting medium) provided by the compressor 3 via the pressure line 7 is purged in the distribution block 4 and in the portion placed downstream of the latter (i.e. the blasting hose 17) for removing moisture or residual that are present in said block and/or in said downstream portion.

Once the third operating mode is performed, the first operating mode can then start by introduction the blasting medium in the distribution block 4 via the control valve 6 so that the resulting dry blasting stream (that is formed by the blasting medium with compressed air) does not find significant moisture in the distribution block itself and/or in the blasting hose 17 and nozzle 15.

Advantageously, when the fourth operating mode is selected, only water, supplied via the supply water circuit 19, and compressed air, provided by the compressor 3 via the pressure line 7, are purged in the distribution block 4 (i.e. with no blasting medium) and in the portion placed downstream of the latter (i.e. the blasting hose) and this operating mode is mainly useful for cleaning the surface with water under pressure.

From the above disclosure, the advantages of the apparatus according to this invention are apparent, since it allows to carry out blasting activities on mutually different surfaces, regardless of their nature, without damaging these surfaces and, in particular, it allows to switch easily and quickly (that is within seconds) from wet to dry blasting, or even vice-versa, thus reducing downtime and enabling a maximum work rate.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. An apparatus for blasting comprising a blasting medium storage means and a distribution block for receiving a blasting medium, a pressure medium and a liquid medium, said distribution block having an outlet connectable with at least one distributing means, said apparatus configured and controlled to comprise:

a first operating mode wherein via the outlet of the distribution block the blasting medium alone, is distributed by the pressure medium;

a second operating mode wherein via the outlet of the distribution block the blasting medium with the liquid medium are distributed by the pressure medium; and a third operating mode wherein via the outlet of the distribution block the pressure medium is distributed alone;

wherein the distribution block comprises a chamber downstream of a control valve and communicating with said control valve and wherein a first inlet for entry of the pressure medium and a second inlet for entry of the blasting medium are defined in the chamber;

wherein the distribution block comprises a coupling element rigidly connected with the chamber and provided with a third inlet for entry of the liquid medium within the distribution block and wherein the coupling element comprises a substantially tubular body that is provided on a lateral wall of the coupling element with the third inlet defining a liquid well ingress into the distribution block;

wherein the coupling element comprises a plurality of internal jets parallel to a direction of flow of the pressure medium and communicating with the liquid well ingress, to inject the liquid medium into the distribution block parallel and in the same direction to the flow of the pressure medium;

wherein the third operating mode is capable of being performed in passing from the second operating mode to the first operating mode;

wherein the apparatus is configured to comprise a further operating mode wherein via the outlet of the distribution block the liquid medium alone, is distributed by the pressure medium;

wherein the blasting medium storage means is connected with the distribution block by the control valve.

2. The apparatus as claimed in claim 1, wherein the first inlet is located upstream of the second inlet and the third inlet.

3. The apparatus as claimed in claim 2, wherein the third inlet is located downstream of the first inlet and the second inlet.

4. The apparatus as claimed in claim 3, wherein the apparatus comprises a compressor configured to provide the pressure medium within the distribution block.

5. The apparatus as claimed in claim 4, further comprising an external compressor operably associated with the apparatus.

6. The apparatus as claimed in claim 5, wherein the apparatus is configured so that, in the first operating mode, the blasting medium is mixed with the pressure medium within the distribution block and in the second operating mode, the blasting medium is mixed with the pressure medium and with the liquid medium within the distribution block.

7. The apparatus as claimed in claim 6, wherein the apparatus further comprises a control panel provided with input means for selecting the operating mode of the apparatus itself.

* * * * *